US005672937A

United States Patent [19]

Choi et al.

[11] Patent Number: 5,672,937

[45] Date of Patent: Sep. 30, 1997

[54] LIGHT-TRANSMITTING ELECTROCONDUCTIVE PLASTIC FILM ELECTRODES AND METHOD OF MANUFACTURE

[76] Inventors: Kue Byung Choi, 51 Park La.; Kue Dong Choi, 10 Floral La.; Kueun Choi, 5 Camelot Dr., all of Trumbull, Conn. 06611; Kyu Taik Choi, Sekyong Apt. 1-205, Kaewoon Dong, Wonju, Rep. of Korea

[21] Appl. No.: 662,866

[22] Filed: Jun. 12, 1996

[51] Int. Cl.[6] ..... H05B 35/10; H05B 35/06

[52] U.S. Cl. ..... 313/503; 445/24; 428/690; 428/697

[58] Field of Search ..... 313/503, 511, 313/509; 445/24, 46; 174/119 C, 126.2, 126.4; 428/690, 697

[56] References Cited

U.S. PATENT DOCUMENTS 4,645,970 2/1987 Murphy ..... 313/509

*Primary Examiner*—Kenneth J. Ramsey
*Attorney, Agent, or Firm*—Perman & Green

[57] ABSTRACT

Flexible translucent electroconductive plastic film electrodes are produced by perforating a normally nonconductive translucent plastic film, and then applying to both surfaces of the film thin layers of a conductive metal oxide such as indium-tin oxide. The conductive layers communicate through the perforations to form an electroconductive film electrode useful with an electroluminescent layer and a rear electrode to form lights, signs and similar electroluminescent laminates.

20 Claims, 1 Drawing Sheet

LIGHT-TRANSMITTING ELECTROCONDUCTIVE PLASTIC FILM ELECTRODES AND METHOD OF MANUFACTURE

FIELD OF THE INVENTION:

The present invention relates to the manufacture of electroconductive sheets or webs suitable for a wide variety of uses, such as in electroluminescent and other electrically-photosensitive thin display devices, lamps, or signs which generate and transmit light in response to passage of electrical current therethrough.

STATE OF THE ART:

A wide variety of composite electroluminescent or electrically-photosensitive thin light-generating, light-transmitting devices are known, and reference is made to Jaffe et al. U.S. Pat. No. 3,315,111; Amans U.S. Pat. No. 3,295,002 and Kawashinma et al. U.S. Pat. No. 5,411,759 for their disclosure of such devices. In all known devices, the composite structure is a laminate containing a cell comprising a front electrode layer or coating, a rear electrode layer or foil and, sandwiched therebetween, an electrically-photosensitive or luminescent layer or coating which generates and emits light in response to the passage of an electric field between the electrode layers. The electroluminescent layer may be printed in the form of a design or message, and the top electrode layer must be not only electroconductive but also light-transmissive to permit the activated design or message to be viewed therethrough. Electrical leads are applied to the top and bottom electrode layers, and the entire cell laminate is encapsulated between protective top and bottom sheets such as transparent, non-conductive plastic films from which the conductive leads extend for passage of current through the laminate to energize the phosphor layer. Among the problems with such devices is the need to provide top electrode layers which are strong, flexible, self-supporting, electroconductive and highly light-transmissive. Conventional inexpensive plastic films are strong, flexible and light-transmissive but not electroconductive. Electroconductive materials such as indium oxide, tin oxide and similar known materials are known coating materials for forming electroconductive and light-transmissive layers but such layers are not self-supporting or strong, per se, and must be formed as layers coated over a phosphor layer present on a base electrode such as an aluminum foil.

There is a need for a self-supporting, inexpensive, strong, flexible plastic film which is electroconductive and light-transmissive and which can be pre-formed in bulk form, such as in continuous web form, for a variety of different uses including the manufacture of electroluminescent devices as discussed hereinbefore.

SUMMARY OF THE INVENTION

The present invention is based upon the discovery that conventional, inexpensive light-transmissive plastic film can be rendered electroconductive and electro-transmissive, while retaining light-transmissive properties, by providing the film with a plurality of closely-spaced small diameter vias, holes or perforations, and then applying to both surfaces of the thin perforated film a thin layer of a light-transmitting, electrically conductive particulate material comprising a conductive metal oxide and preferably an adhesive binder material. The layers on opposite surfaces of the supporting plastic film are in electro-communication since the conductive particulate material fills the perforations or holes in the body of the plastic film, forming conductive vias therethrough without substantially reducing the light-transmissive properties of the film. Thus the application of an electric current to any area of the top surface coating of the film is conducted, through the filled vias, to the bottom surface coating of the film, to provide an electro-transmissive, light-transmissive plastic film which retains all of the desirable properties of the plastic film while overcoming its normal insulation properties.

THE DRAWINGS

DETAILED DESCRIPTION OF THE INVENTION

Figure 1:
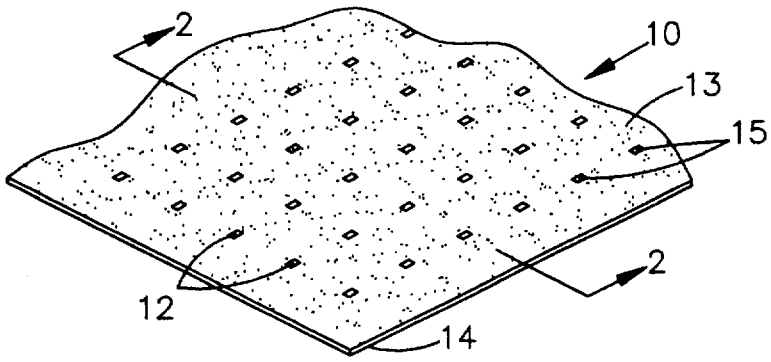
FIG. 1 is perspective view of a light-transmissive electroconductive plastic film electrode according to an embodiment of the present invention.
Figure 2:
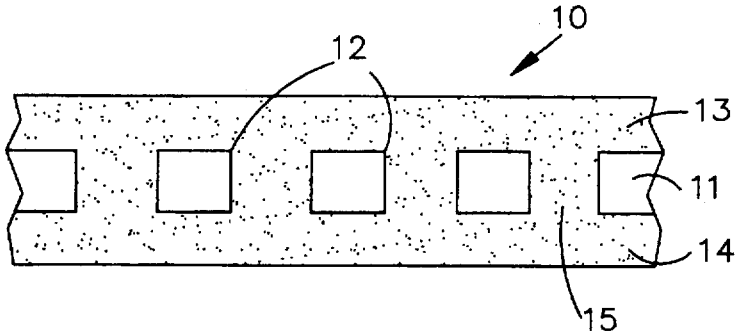
FIG. 2 is cross-section taken along the line 2—2 of FIG. 1.

Referring to the drawing, FIGS. 1 and 2, a sheet or web of thin flexible, clear plastic film 11, such as polyethylene terephthalate (Mylar), polyethylene, polypropylene, nylon, cellophane or other similar strong film having a thickness of from 0.25 to about 50 mil (0.00025 inch to 0.05 inch) is provided with a plurality of closely-spaced perforations or holes 12, preferably accomplished by automatic laser burning, mechanical punching or perforation means while the film is in continuous web form.

Next the perforated film is provided on both surfaces with a continuous thin layer or coating of a conventional electroconductive, translucent metal oxide such as an indium-tin oxide (ITO) layer deposited by reactive sputtering of an indium-tin target in the presence of oxygen. This procedure forms continuous translucent electroconductive deposits on both surfaces of the film and in the holes 12 through the film to form conductive vias 15.

This provides strong, flexible, translucent, self-supporting electroconductive plastic films 10 or electrode films which are manufactured in bulk, independently of any other components with which they might be used, such as a second electrode layer or a phosphor layer or electrical contacts or leads.

Figure 3:
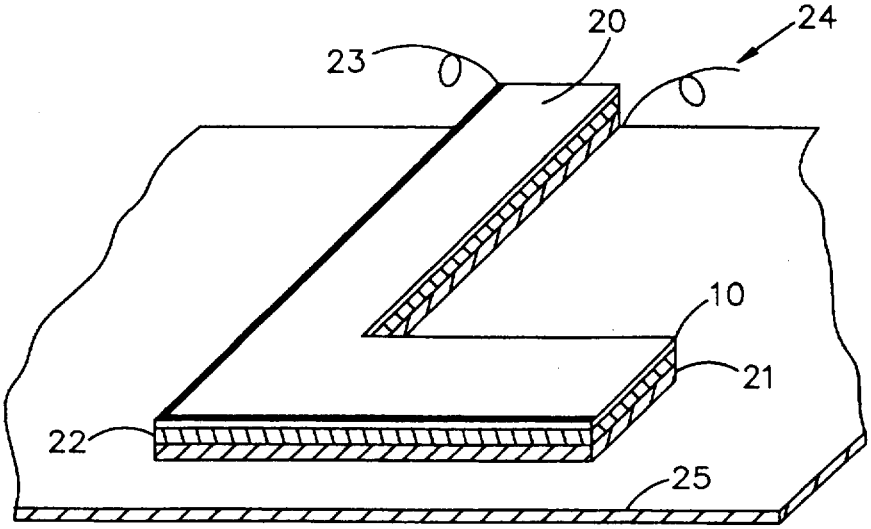
FIG. 3 is a diagrammatic cross-section of an electroluminescent light or display sign according to an embodiment of the invention.

Referring to FIG. 3 of the drawings, an electroluminescent light or display sign is illustrated comprising spaced designs 20 or letters, each consisting of a laminate of a top electrode layer 10, as in FIGS. 1 and 2, a middle luminescent layer 22, such as a zinc sulfide phosphor layer, and a base electrode layer 21, such as aluminum foil, attached to a non-conductive support surface 25, such as glass or plastic.

The spaced designs may be ornamental figures or numbers or letters cut or punched from a laminate sheet or web. For example a sheet or web of thin aluminum foil can be coated with a conventional electroluminescent composition comprising conventional phosphor material, such as zinc sulfide containing a small amount of a transition metal, such as manganese, in conventional manner, and then laminated to a sheet or web of the top electrode conductive film. Alternatively, the phosphor layer may be coated onto the top electrode conductive film and then laminated to the bottom electrode foil to form the assembly.

Essentially, the present invention relates to the treatment of flexible, strong, translucent, sheet material which is not electroconductive, such as plastic film, to render it electroconductive without destroying its normal properties of translucency, flexibility and strength. This is accomplished by laser-burning, punching, piercing or otherwise perforating the sheet with holes small enough to be filed with a deposit of a translucent electroconductive salt, such as indium-tin oxide, when the opposed surfaces of the perforated sheet are coated with continuous layers of the electroconductive salt in conventional manner, such as by reactive sputtering, vapor deposition or other techniques for applying thin, continuous, translucent layers. Reference is made, for example, to U.S. Pat. No. 5,489,489.

The present plastic films or webs preferably are perforated by means of conventional mechanical punching or perforating devices or by laser devices to form a plurality of random or uniform closely spaced holes having small diameters, such as between about 0.001 inch and 0.06 inch in diameter and spaced by between about 0.004 inch up to about 1.0 inch. Reference is made to U.S. Pat. Nos. 3,226,527; 4,218,606 and 4,743,123 for their disclosure of laser devices for perforating plastic sheet materials, which may be used according to the present invention.

While the present translucent electrode sheets are suitable for a variety of different uses in which the ability to see through an upper electrode or the ability to transmit light through an upper electrode are essential, the present electrode sheets are particularly useful in planar, thin electroluminescent lights or signs in association with a flexible rear electrode and an electroluminescent phosphor layer which is sandwiched therebetween for activation and light-emission when an electric field is passed between the front and rear electrode sheets.

The phosphor layer may be coated onto either the front surface of the rear electrode sheet or the rear surface of the front, translucent electrode sheet. The rear electrode sheet need not be translucent, such as thin aluminum foil, but can be the same as the novel translucent film used as the front electrode sheet, in which case the illuminated sign, such as a design, can be viewed from both sides if the sign is affixed to a transparent support such as a glass window.

A variety of phosphor coating compositions are known in the art, and reference is made to U.S. Pat. Nos. 5,294,368 and 5,411,759 for their disclosure of suitable compositions and processes for coating same.

An important advantage of the novel translucent electrode films of the present invention, and of laminates thereof with electro-luminescent layers and rear electrode sheets, such as aluminum foils, is that they can be produced in the form of large sheets or webs and subsequently cut into individual designs, letters or numbers which are self-supporting and can be assembled as spaced elements of a sign prior to attachment of electrode leads to the upper and lower electrodes, and between the electrode layers of one design, letter or number and the next, as illustrated by the conductive wires 23 and 24 in FIG. 3. This is not possible with prior known devices in which two layers thereof are encased within protective top and bottom films after attachment of the electrical leads.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A strong, flexible, translucent electroconductive plastic film electrode comprising a thin, normally non-electroconductive sheet of strong, flexible, translucent plastic film which is provided with a plurality of closely-spaced narrow openings through the thickness thereof and over the entire surface area thereof, said sheet being coated over the front and rear surfaces thereof with a continuous translucent layer Of an electroconductive composition which extends through said openings to produce electroconductive continuity between said front and rear surfaces and form said plastic film electrode.

2. An electroconductive plastic film electrode according to claim 1 in which said plastic film has a thickness between about 0.5 and 50 mils.

3. An electroconductive plastic film electrode according to claim 1 in which said plastic film is selected from the group consisting of polyethylene terephthalate, polyethylene, polypropylene, nylon and cellophane.

4. An electroconductive plastic film according to claim 1 in which said electroconductive composition comprises a metal oxide layer which contains a minor amount of a resinous binder material having good affinity for the surfaces of the plastic film.

5. An electroconductive plastic film according to claim 1 in which the said electroconductive composition comprises an indium oxide.

6. An electroconductive plastic film according to claim 5 in which the indium oxide comprises indium-tin oxide.

7. An electroconductive plastic film electrode according to claim 1 for use in an electroluminescent display device, comprising a said plastic film electrode further coated over the conductive layer on one side thereof with a continuous electroluminescent layer of a phosphor compound.

8. An electroconductive plastic film electrode according to claim 7 in which said layer of phosphor compound also comprises a minor amount of a resinous binder material having an affinity for said conductive layer.

9. An electroconductive plastic film electrode according to claim 1 for use as an electroluminescent display device, comprising a said plastic film electrode as a front electrode, a rear flexible electroconductive sheet as a rear electrode, and sandwiched therebetween a continuous electroluminescent layer of a phosphor compound, the passage of an electric field from one electrode sheet, through said layer of phosphor compound and through the other electrode sheet causing said electroluminescent layer to emit light which is visible through said front electrode.

10. An electroconductive plastic film electrode according to claim 9 comprising a perforated polyethylene terephthalate front electrode coated with indium oxide; an intermediate electroluminescent phosphor layer, and a conductive rear electrode of aluminum foil.

11. A method for producing a strong, flexible, translucent electroconductive plastic film electrode comprising the steps of:

(a) forming a plurality of closely-spaced, narrow openings through the thickness of and over the surface area of a normally non-conductive sheet of strong, translucent plastic film, and (b) coating the front and rear surfaces of said plastic film with a thin, translucent, continuous layer of an electroconductive composition which extends through said openings to produce electroconductive continuity between said front and rear surfaces and form said plastic film electrode.

12. A method according to claim 11 in which said plastic film has a thickness between about 0.5 and 50 mils.

13. A method according to claim 11 in which said plastic film is selected from the group consisting of polyethylene terephthalate, polyethylene, polypropylene, nylon and cellophane.

14. A method according to claim 11 in which said electroconductive composition comprises a metal oxide layer containing a minor amount of a resinous binder material having good affinity for the surfaces of the plastic film.

15. A method according to claim 11 in which the said electroconductive composition comprises an indium oxide.

16. A method according to claim 15 in which the indium oxide comprises indium-tin oxide.

17. A method according to claim 11 for preparing an electroluminescent display device, comprising coating said plastic film electrode over the conductive layer on one side thereof with a continuous electroluminescent layer of a phosphor compound.

18. A according to claim 17 in which said layer of phosphor compound also comprises a minor amount of a resinous binder material having an affinity for said conductive layer.

19. A method according to claim 11 for producing an electroluminescent display device, comprising assembling a said plastic film electrode as a front electrode, a rear flexible electroconductive sheet as a rear electrode, and sandwiching therebetween a continuous electroluminescent layer of a phosphor compound, and passing an electric field from one electrode sheet, through said layer of phosphor compound and through the other electrode sheet to cause said electroluminescent layer to emit light which is visible through said front electrode.

20. A method according to claim 19 comprising the steps of coating a perforated polyethylene terephthalate front electrode with indium oxide, and laminating therewith an intermediate electroluminescent phosphor layer, and a conductive rear electrode of aluminum foil to form an electroluminescent assembly.

* * * * *